US005553746A

United States Patent [19]

Jones

[11] Patent Number: 5,553,746

[45] Date of Patent: Sep. 10, 1996

[54] PLAIN WATER PRESSURE BOOST SYSTEM FOR A CARBONATED BEVERAGE DISPENSER

[75] Inventor: Brian C. Jones, Collinsville, Conn.

[73] Assignee: Wilshire Partners, Cleveland, Ohio

[21] Appl. No.: 366,474

[22] Filed: Dec. 30, 1994

[51] Int. Cl.[6] ..... B67D 5/62

[52] U.S. Cl. ..... 222/129.1; 222/146.6; 222/318

[58] Field of Search ..... 222/63, 64, 129.1, 222/144.5, 318, 330, 333, 399, 146.6, 504; 137/563

[56] References Cited

U.S. PATENT DOCUMENTS

| | | | |
|---|---|---|---|
| 2,978,143 | 4/1961 | Arnett et al. | 222/318 |
| 3,348,737 | 10/1967 | Yingst et al. | 222/318 |
| 3,731,845 | 5/1973 | Booth | 222/318 |
| 3,853,244 | 12/1974 | Neumann | 222/129.1 |
| 5,033,645 | 7/1991 | Shannon et al. | 222/61 |

*Primary Examiner*—Andres Kashnikow
*Assistant Examiner*—Philippe Derakshani
*Attorney, Agent, or Firm*—Vickers, Daniels & Young

[57] ABSTRACT

A plain water boost system for a carbonated beverage dispenser provides for a pressure boost of plain water to be dispensed without the need for a second pump. A pressure regulator protected by an isolation valve is actuated when plain water is dispensed to reduce the output pressure of the carbonator input pump to an appropriate level for dispensing pressure boosted plain water.

19 Claims, 2 Drawing Sheets

PLAIN WATER PRESSURE BOOST SYSTEM FOR A CARBONATED BEVERAGE DISPENSER

BACKGROUND OF THE INVENTION

Figure 1:
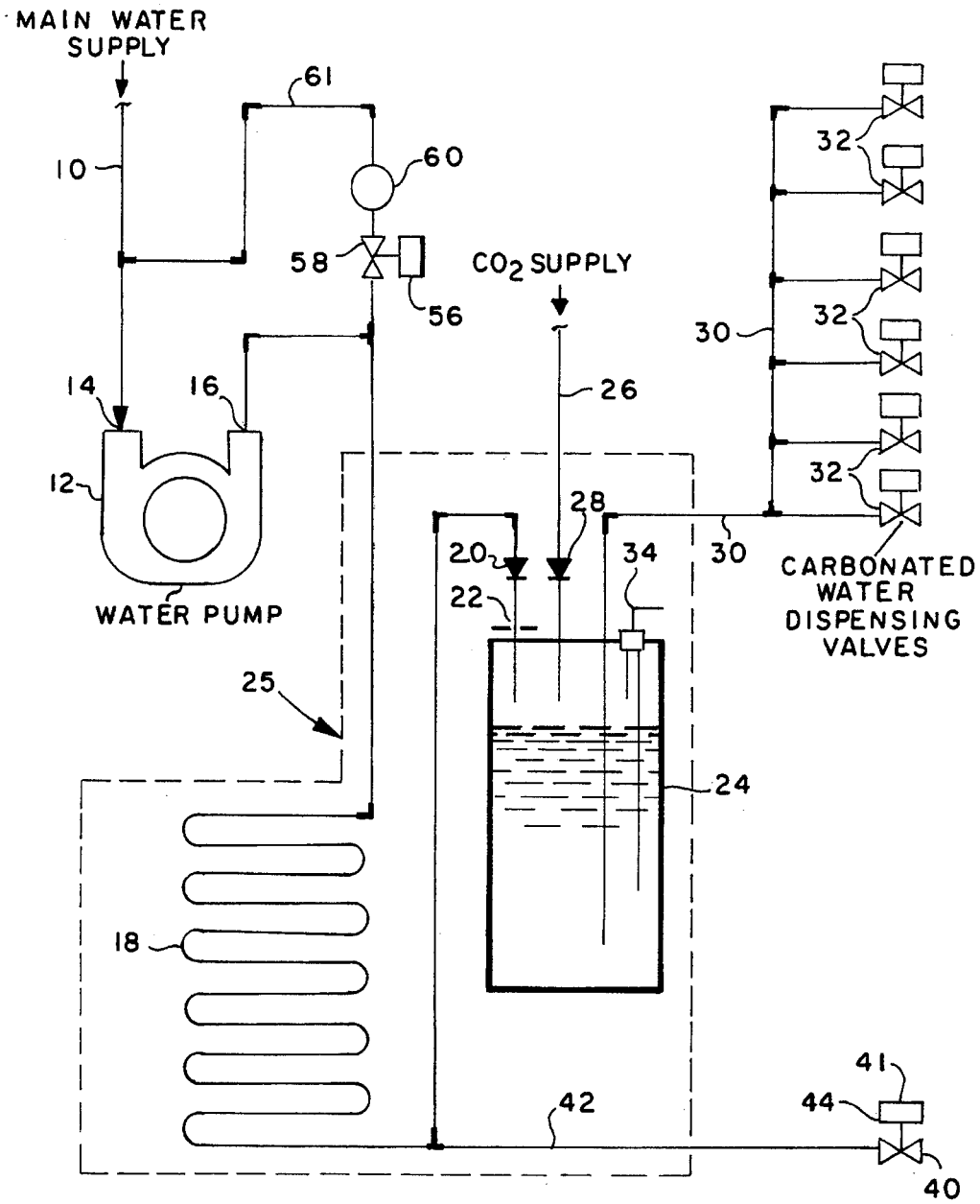

The present invention relates to a plain water pressure boost system facilitating the dispensing of non-carbonated beverages from carbonated beverage dispensers. More specifically, the present invention relates to assemblies for dispensing non-carbonated drinks at a reasonable rate in environments where the main water supply pressure is deficient.

Some types of post mixed beverage dispensers include means of chilling water and syrup, a carbonator for making carbonated water from plain water and dispensing valves which mix syrup with carbonated water or plain water and dispense them into cups for consumers. The carbonator often comprises a tank into which plain water (often referred to as sweet water) and carbon dioxide are introduced. The carbon dioxide enters into solution in the water forming carbonated water. The sweet water is often chilled prior to introduction into the carbonator tank as carbonation takes place more efficiently in chilled water. Both the water and the carbon dioxide are introduced into the tank under pressure. The tank pressure is approximately the same as the carbon dioxide supply pressure, typically 75 lbs/in$^2$. This is normally accomplished for the water by means of a carbonator water pump which is often physically closely associated with the carbonator tank itself. Sweet water is provided to the pump, is pressurized and then injected into the carbonator tank at a pressure greatly in excess of 75 lbs/in$^2$. The high sweet water inlet pressure is needed to overcome the flow resistance of an inlet orifice which creates a high velocity water stream to promote carbonation through resultant turbulant mixing inside the tank. Carbonated water is withdrawn from the tank, sometimes finish chilled, mixed with syrup and dispensed with the dispensing valves as a carbonated finished drink.

It is often desirable to also dispense non-carbonated drinks from the same beverage dispenser. Such non-carbonated drinks can be plain water or water mixed with a flavoring or fruit based syrup as the retailer desires. Water is generally taken from the main supply, chilled and provided directly to the plain water valve. While this arrangement works well in many applications, problems have been encountered.

The main water supply in many locations can be deficient in pressure. This deficiency can be chronic due to location. Dispensers located at higher elevations or in remote locations are sometimes provided with uniformly low water pressure which makes dispensing of non-carbonated drinks a very slow and tedious process. Because the pressure is low, the flow rate is low and dispensing takes significantly longer than is desirable. The low plain water flow rate may also adversely reduce the mix ratio of water-to-syrup, making the quality of the finished drink unacceptable. Often, a beverage dispenser normally provided with acceptable water pressure will intermittently be provided with unacceptable pressure because of other demands on the water supply in close proximity to the dispenser. Thus, a beverage dispenser on a supply branch line which also feeds other appliances with high water demand may sometimes be provided with unacceptable low pressure. Even when water pressure is in a normally acceptable range, the pressure loss through the beverage dispenser's chilling coils may reduce flow to unacceptably low levels. In either case, the productivity of the beverage dispenser itself and the food services establishment which it serves are adversely affected.

One way of addressing this problem which has been used in the past is to simply install a booster pump in the water supply line. This is expensive to install, often requires extra maintenance, and takes up valuable space.

Accordingly, the problem of low water pressure has not been adequately addressed and a need exists for a beverage dispenser which can provide both carbonated and non-carbonated beverages at a reasonable dispensing rate and mix ratio inexpensively, compactly and conveniently.

The Invention

In accordance with the invention, there is provided a carbonated beverage dispenser having a water pump, a carbonator receiving pressurized water from the water pump, carbonated beverage dispensing valves receiving carbonated water from the carbonator and syrup, which mix this carbonated water and syrup to dispense it as a mixed drink, at least one non-carbonated beverage dispensing valve and a pressure regulator adapted to maintain the pressure of water received by the non-carbonated beverage dispensing valve at or below a selected pressure less than the nominal pressure of the pump.

Further in accordance with the invention, the pressure regulator is a bypass pressure regulator maintaining the pressure rise developed by the water pump at the selected level by allowing the flow of a portion of the output of the pump to return to the inlet of the pump.

Still further in accordance with the invention a valve is provided in series with the pressure regulator allowing flow to the pressure regulator only when the non-carbonated beverage dispensing valve is actuated.

Still further in accordance with the invention the plain water boost system is only operative when plain water dispensing is occurring and is not operative at other times.

It is the primary object of the present invention to provide a plain water pressure boost system facilitating the dispensing of plain water drinks at a correct pressure level without over pressurization, even when main water supply pressure is low.

It is another object of the present invention to provide a plain water boost system without requiring an additional pump.

It is another object of the present invention to provide a plain water boost system facilitating the dispensing of plain water drinks and carbonated water drinks either sequentially or at the same time even in an area of low pressure main water supply.

It is still another object of the present invention to provide a plain water boost system which is inexpensive to manufacture, inexpensive to operate and provides a compact design.

It is yet another object of the present invention to provide a plain water boost system in a beverage dispenser which is installed in a manner identical to a conventional dispenser whereby training costs are minimized.

It is yet another object of the present invention to provide a plain water boost system which is completely automatic in operation.

It is yet another object of the present invention to provide a plain water boost system not requiring a separate circuit and circuit breaker for an auxiliary pump.

Figure 2:
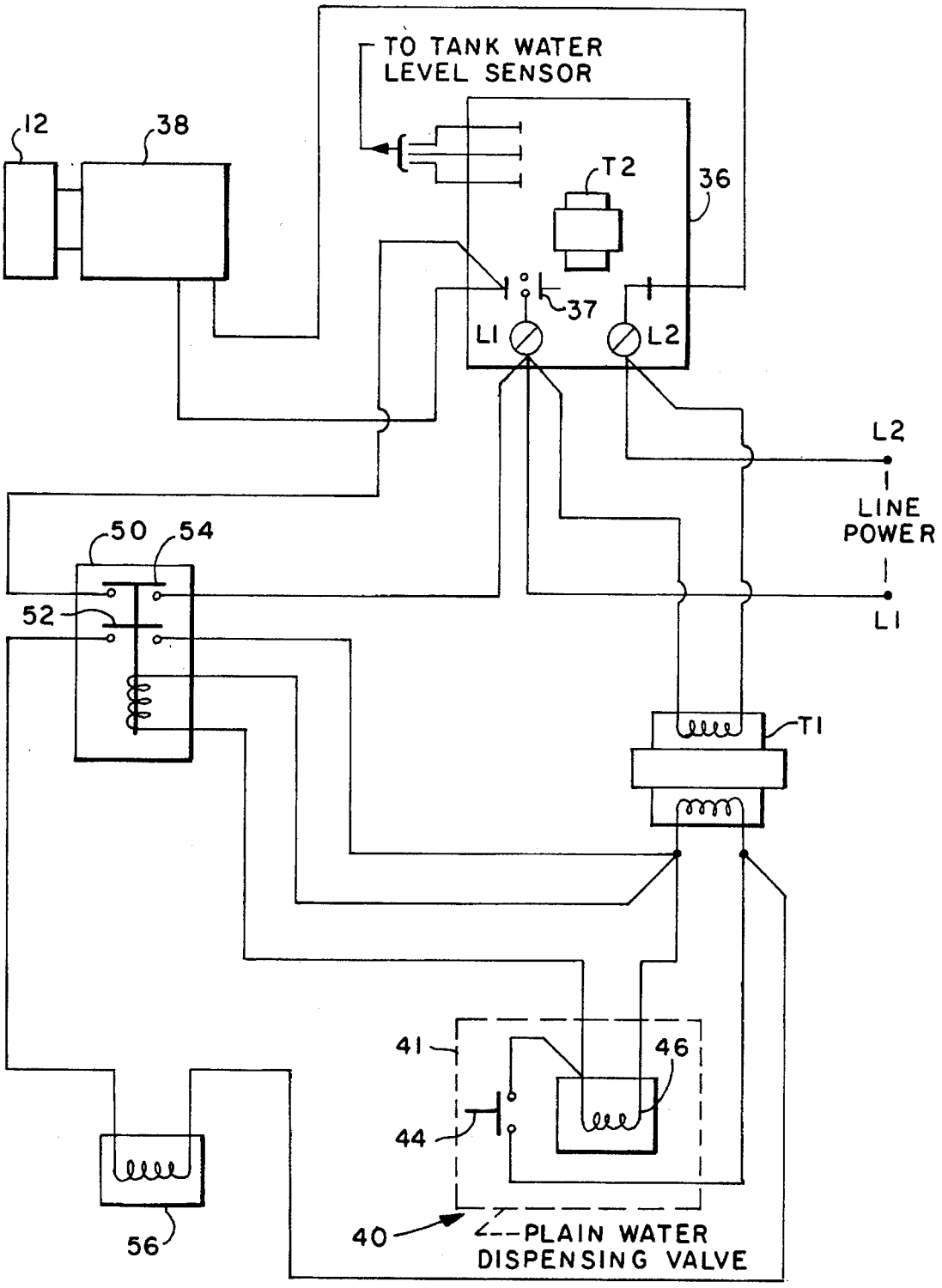

The invention may take physical form in certain parts and arrangements of parts, a preferred embodiment of which will be described in detail in this specification and illustrated in the accompanying drawings which form a part hereof and wherein:

FIG. 1 schematically illustrates the liquid carrying components and mechanical parts of the invention; and, FIG. 2 schematically illustrates the electrical interconnection of these parts and the electrical parts of the invention seen in FIG. 1.

Referring now to the drawings wherein the showings are made for the purposes of illustrating a preferred embodiment of the invention only and not for the purpose of limiting same, FIG. 1 shows the mechanical components of a fresh water and carbonated water system incorporating the present invention as used in an otherwise conventional beverage dispensing unit. Beverage dispensing units are well known in the art and available commercially from a number of sources including Wilshire, the assignee of the present application. Such beverage dispensers have been fully described previously in patents and other publications and will not be described in detail herein.

Water is received from city water or the like at a main water supply 10. A water pump 12 receives water from the main water supply at its inlet 14. When the pump is energized, high pressure water is provided at the pump outlet 16. The high pressure water flows through a plain water pre-chill coil 18 through a check valve 20, an orifice 22 and into the body of carbonator tank 24. If the unit is mechanically refrigerated the pre-chill coil 18 and carbonator tank 24 are immersed in water bath 25 (shown schematically). The water bath is kept cold by an evaporator (not shown) upon which an ice bank is formed. The pre-chilled water enters the carbonator tank at high velocity because of the small orifice thereby causing turbulence and intimate mixing of carbon dioxide bubbles in the body of water contained within the tank aiding carbonation. The water must be under high pressure entering the carbonator tank as the carbonator tank is maintained at high pressure so that the carbon dioxide gas will go into solution. Typically, the carbonator tank is kept at about 70 lbs/in$^2$. The output pressure of the water pump 12 must be higher than the nominal pressure of the carbonator tank as pressure losses occur in the pre-chill coil 18, the check valve 20 and the orifice 22. Typical pump output pressure rise is 120–170 lbs/in$^2$ depending in large part on the flow restriction imparted by the orifice 22. If flow is fully restricted, the pump pressure rise may increase to as high as 170–250 lbs/in$^2$ depending on the pump design.

Carbon dioxide is introduced into the carbonator 24 through a carbon dioxide supply line 26 and a check valve 28 at about 70 lbs/in$^2$.

Carbonated water from the carbonator 24 flows through carbonated water lines 30 to carbonated beverage dispensing valves 32 upon demand. When such demand causes the level of carbonated water in the carbonator 24 to drop below a selected level, a water level sensor 34 sends a signal to a liquid level controller 36 (FIG. 2). The controller actuates the motor 38 (FIG. 2) driving the pump 12 to refill the carbonator tank 24 with water. The pump 12 operates at a pressure sufficiently high to charge the tank 24 to a selected high level whereupon the sensor 34 sends another signal and the motor 38 is turned off. Thus, the dispensing of a carbonated drink is facilitated regardless of inlet pressure at the main water supply 10. Conventionally, plain water drinks were provided for by tapping into the main water supply downstream from the pre-chill coil 18 but upstream from the carbonator check valve 20 and providing the plain water to the plain water dispensing valve 40 at main water supply pressure less the flowing pressure losses through the supply lines.

As can be seen in FIG. 1, in the present invention, a plain water line 42 connects the output of the pre-chill coil to the plain water dispensing valve 40. The plain water dispensing valve 40 is electrically operated by switch 44 and solenoid 46 enclosed by electrical envelope 41 as can be seen in FIG. 2. The switch is typically a manually actuated momentary contact switch on the body of the valve itself. Such a switch and its location is conventional. The switch 44, when depressed, provides current to a solenoid 46 which physically opens the plain water dispensing valve allowing water and, if desired, flavoring syrup, to be dispensed. Syrup would be supplied by a solenoid operated syrup valve also electrically connected to the switch 44. The solenoid 46 is supplied with current from a transformer T1. When the switch 44 is depressed, current is also supplied from the transformer through the switch to a double pole single throw relay 50. When energized, two sets of contacts of the relay 50 close. The first set of contacts 52 completes a circuit from the transformer T1 to an isolation valve solenoid 56. The second set of contacts 54 completes a line current circuit to the pump motor 38 driving the water pump 12. As can be seen in FIG. 1, the isolation valve solenoid 56 opens a normally closed isolation valve 58 which allows water from the pump outlet 16 to flow through a pressure regulator 60 and return line 61 to the pump input 14. The pressure regulator 60 is set to maintain a desired pressure difference across the regulator and likewise across the pump 12, at a level appropriate for the plain water dispensing valve 40. This pressure difference is typically 50 lbs/in$^2$. The pressure regulator 60 relieves the pressure at the outlet 16 by allowing water to flow through the regulator 60 to the pump inlet 14.

In effect, the pump 12 is caused to operate at two different outlet pressures. When plain water dispensing is desired and the dispensing switch 44 depressed, the regulator 60 is introduced into the water circuit by the opening of valve 58. This regulator controls the output of the pump 12 to a selected pressure appropriate for dispensing plain water drinks i.e. 70 lb/in$^2$. Thus, if the main water supply pressure were 20 lb/in$^2$ and pump pressure rise set by the pressure regulator were 50 lb/in$^2$ then the pump discharge pressure would be 70 lb/in$^2$. When the plain water dispensing valve is not in operation, the valve 58 is closed and the pressure regulator is removed from the plain water circuit. The pump 12 is then free to operate at full output pressure rise, i.e. 120–170 lb/in$^2$ upon the demand of the liquid level controller 36 and liquid level sensor 34 whereby the carbonator tank 24 is maintained in a full pressurized condition.

As can be seen in FIG. 2, the pump motor 38 is provided with two independent means of obtaining current. The first is the liquid level controller 36. The liquid level controller 36 receives current at main supply voltage through lines L1 and L2 as is conventional. A tank water level sensor 34 with its internal voltage supply provided by the controller 36 and the transformer T2, provides signals to the controller indicative of a tank low water level. Contacts 37 on the controller 36 are closed supplying line current to the pump motor 38. Similarly, when the tank is full, the controller interrupts current to the pump motor by opening of contacts 37 and the pump stops. Line L1 is switched by contacts 37 while line L2 is direct connected to the pump motor 38. Alternatively, as described above, line current to motor 38 through line L1 can be provided through the second set of contacts 54 of the double pole single throw relay 50. This is independent of the action of the liquid level controller 36.

Alternatives to the embodiment of the invention include placing the pump 12, the regulator 60 and the isolation valve 58 downstream of the pre-chill coil 18. This modification may be appropriate for units in which the water pressure pump is already mounted on the carbonator tank assembly. However, the modification would circulate already pre-chilled water and could result in warmer water being supplied to the carbonator than is desired. Alternatively, the bypass water need not be recirculated but can be used for other purposes or discarded.

Another modification is to connect the regulator 60 and the isolation valve 58 in a parallel connection downstream from the pump 12, with isolation valve 58 being normally open. This will cause the same operating function as previously described.

The invention has been described with reference to a preferred embodiment. Obviously, modifications and alterations as described above and otherwise will occur to others upon a reading and understanding of this specification and it is intended to include such modifications and alterations insofar as they come within the scope of the appended claims or their equivalents.

Having thus defined the invention, it is claimed:

1. In a carbonated beverage dispenser comprising a water pump having an inlet and an outlet and a nominal outlet pressure, a carbonator adapted to receive water from said pump outlet, at least one carbonated beverage dispensing valve and at least one non-carbonated beverage dispensing valve, the improvement comprising:

said non-carbonated dispensing valve being adapted to receive water from said pump outlet, said carbonated dispensing valve adapted to receive carbonated water from said carbonator, a pressure regulator connected to said pump outlet, said regulator adapted to maintain the pressure at said pump outlet at a selected pressure less than said nominal outlet pressure, an isolation valve adapted to allow flow into said regulator when said non-carbonated beverage dispensing valve is actuated and to stop flow into said regulator when said non-carbonated beverage dispensing valve is not actuated; and, means energizing said pump when said non-carbonated beverage dispensing valve is actuated.

2. The improvement of claim 1 wherein said means energizing said pump comprises a relay and said relay also actuates said isolation valve.

3. The improvement of claim 2 wherein said relay is a double pole single throw relay.

4. The improvement of claim 2 wherein said non-carbonated dispensing valve includes an electrical switch, said switch controlling said relay.

5. The improvement of claim 4 wherein said non-carbonated dispensing valve is an electrically actuated valve and said switch controls both said electrically actuated valve and said relay.

6. The improvement of claim 1 wherein said pressure regulator has a bypass outlet and said bypass outlet is connected to said pump inlet.

7. In a water circuit of a carbonated beverage dispenser having: a carbonator; a water pump adapted to supply high pressure water to said carbonator with an inlet, an outlet and a nominal outlet pressure; at least one carbonated beverage dispensing valve adapted to receive water from said carbonator; and, at least one non-carbonated beverage dispensing valve; the improvement comprising:

said non-carbonated dispensing valve being adapted to receive water from said pump outlet;

a pressure regulator adapted to limit the pressure of water received by said non-carbonated dispensing valve to a selected pressure less than said nominal outlet pressure.

8. The improvement of claim 7 wherein said pressure regulator is only active when said non-carbonated beverage dispensing vale is actuated.

9. The improvement of claim 7 wherein an isolation valve is connected in series with said regulator whereby water flows to said regulator only when said isolation valve is actuated.

10. The improvement of claim 9 wherein said non-carbonated beverage dispensing valve has an electrical switch, said switch adapted to actuate said dispensing valve and said isolation valve.

11. The improvement of claim 10 wherein said switch actuates a relay which in turn actuates said isolation valve and said pump.

12. The improvement of claim 7 wherein a pre-chill coil receives water from said pump and provides water to said non-carbonated dispensing valve.

13. In a carbonated beverage dispenser comprising a water pump having an inlet and an outlet and a nominal pressure rise, a carbonator adapted to receive water from said pump outlet, at least one carbonated beverage dispensing valve and at least one non-carbonated beverage dispensing valve, the improvement comprising:

said non-carbonated dispensing valve being adapted to receive water from said pump outlet, said carbonated dispensing valve adapted to receive carbonated water from said carbonator, a pressure regulator connected between said pump inlet and said pump outlet, said regulator adapted to maintain the pressure rise across said pump at a selected pressure rise less than said nominal pressure rise of said pump, an isolation valve adapted to allow flow into said regulator when said non-carbonated beverage dispensing valve is actuated and to stop flow into said regulator when said non-carbonated beverage dispensing valve is not actuated; and, means energizing said pump when said non-carbonated beverage dispensing valve is actuated.

14. The improvement of claim 13 wherein said means energizing said pump comprises a relay and said relay also actuates said isolation valve.

15. The improvement of claim 14 wherein said relay is a double pole single throw relay.

16. The improvement of claim 14 wherein said non-carbonated dispensing valve includes an electrical switch, said switch controlling said relay.

17. The improvement of claim 16 wherein said non-carbonated dispensing valve is an electrically actuated valve and said switch controls both said electrically actuated valve and said relay.

18. In a water circuit of a carbonated beverage dispenser having:

a carbonator;

a water pump adapted to supply high pressure water to said carbonator with an inlet, an outlet and a nominal outlet pressure;

at least one carbonated beverage dispensing valve adapted to receive water from said carbonator; and, at least one non-carbonated beverage dispensing valve;

the improvement comprising:

a bypass line connected between said pump inlet and said pump outlet; and, a valve in said bypass line allowing flow only when said at least one non-carbonated beverage dispensing valve is activated.

19. The improvement of claim 18 wherein a pre-chill coil receives water from said pump and provides water to said non-carbonated dispensing valve.

* * * * *